United States Patent [19]

Förster et al.

[11] 4,116,125

[45] Sep. 26, 1978

[54] CONTROL SYSTEM FOR POSITIONING UNITS EXHIBITING DEAD TIME IN THEIR RESPONSE TO ACTIVATING SIGNALS

[75] Inventors: Karl-Heinz Förster, Dresden; Werner Lein, Radebeul, both of German Democratic Rep.

[73] Assignee: Veb Polygraph Leipzig Kombinat fur Polygraphische Maschinen und Ausrustungen, Leipzig, German Democratic Rep.

[21] Appl. No.: 782,544

[22] Filed: Mar. 29, 1977

[30] Foreign Application Priority Data

Mar. 29, 1976 [DD] German Democratic Rep. ... 192088

[51] Int. Cl.[2] ..... B41F 13/24

[52] U.S. Cl. ..... 101/212; 101/184

[58] Field of Search ..... 101/181, 183, 184, 185, 101/136, 137, 141, 232, 236, 237, 238, 239, 247, 212, 216

[56] References Cited

U.S. PATENT DOCUMENTS

| | | | |
|---|---|---|---|
| 3,762,320 | 10/1973 | Johne et al. | 101/183 |
| 3,818,827 | 6/1974 | Johne et al. | 101/232 |

*Primary Examiner*—J. Reed Fisher

*Attorney, Agent, or Firm*—Michael J. Striker

[57] ABSTRACT

A printing machine operates at a variable speed, and includes a rotary reference component. Activation and deactivation of positioning units for printing cylinders and other functional units for the printing machine is performed in synchronization with the rotation of the rotary reference component. The positioning units exhibit dead times in their response to applied activating or deactivating signals. The duration of each such dead time expressed in terms of the extent of angular movement of the rotary reference component varies in dependence upon printing machine operating speed, tending to produce improper synchronization between activation and deactivation of positioning units, on the one hand, and machine operation, on the other hand. The speed of operation of the printing machine is monitored and employed to automatically introduce a compensatory time delay into the application of activating or deactivating signals to the positioning units, to compensate for the dead times and maintain proper synchronization.

9 Claims, 3 Drawing Figures

CONTROL SYSTEM FOR POSITIONING UNITS EXHIBITING DEAD TIME IN THEIR RESPONSE TO ACTIVATING SIGNALS

BACKGROUND OF THE INVENTION

The invention relates to control systems for controlling the activation and deactivation of functional units of a printing machine, for example the throw-on and throw-off of printing cylinders, inking cylinders and other functional units.

Typically, the functional unit to be activated or deactivated is moved by a positioning unit to which the activating or deactivating signal per se is applied. However, such positioning units, such as electrohydraulic or electromagnetic or electromechanical positioning units, usually exhibit dead times in their response to activating (i.e., activating or deactivating) signals. The dead time is in part attributable to the finite time required for energization or deenergization of the electrohydraulic, electromagnetic or electromechanical positioning unit, and is in part attributable to the finite distance through which the positioning unit must move a component of the functional unit (for example a printing cylinder from thrown-off to thrown-on position).

German Democratic Republic patent DL No. 93 784 and U.S. Pat. No. 3,818,827 disclose printing machine control systems operating on a clocked basis. For example, a sheet-representing signal is advanced through successive shift-register stages of a control shift register, under the control of clock pulses applied to the shift register by a synchronizer driven by a rotary reference component of the printing machine. The advancement of the sheet-representing signal through the successive shift-register stages simulates the travel of a sheet through the printing machine. When the sheet-representing signal reaches predetermined successive shift-register stages, functional units of the machine are activated or deactivated, e.g., printing cylinders are thrown on or off. The advancement of the sheet-representing signal from one shift-register stage to the next corresponds to predetermined increments of angular movement of the rotary reference component of the machine.

Proper synchronization can be lost if the machine is operable at a variable speed, and if the dead times of the positioning units (referred to above) are not negligible. The dead time of each positioning unit, when expressed in terms of the extent of angular movement of the rotary reference component of the printing machine, is a function of the angular velocity of the rotary reference component, i.e., of the speed of operation of the printing machine. Accordingly, synchronization based upon the angular position of the rotary reference component cannot be maintained if the speed of operation of the printing machine varies.

SUMMARY OF THE INVENTION

It is a general object of the invention to compensate for the effect of positioning-unit dead times upon proper angular synchronization of a printing machine capable of operating at variable speed.

According to the broadest concept of the invention, the effect of positioning-unit dead time upon proper synchronization is compensated for by introducing into the application of activating (i.e., activating or deactivating) signals to the positioning units a time delay which is automatically varied in dependence upon the angular velocity of the rotary reference component of the printing machine.

According to a more specific concept of the invention, a pulse generator is used to generate pulses indicative of incremental angular movement of the rotary reference component of the printing machine. These pulses are applied to a calculating unit which calculates the amount of compensatory time delay required to compensate for the positioning-unit dead time at the prevailing operating speed of the printing machine. The time-delay amount thusly calculated is converted by a converter unit into a form utilizable for actual implementation of the compensatory time delay, e.g. is converted into a compensatory time-delay interval.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

The control signal for a positioning unit which exhibits a dead time upon receipt of its activation signal must be delayed in dependence upon the angular velocity of a rotating component of the printing machine (e.g., a printing roller of the machine) to compensate for the dead time. The angle by which the actuating signal for the positioning unit is to be delayed is referred to herein as the delay angle.

The delay angle is smaller at higher angular velocities than at lower angular velocities. The dependence of the delay angle $\beta$ upon the angular velocity $w$ of the rotating component of the printing machine employed for reference purposes, is given by the equation $$\beta = -aw + b$$

In this equation, $a$ is a constant predetermined by the structure of the machine, and $b$ is likewise a constant.

Figure 1:
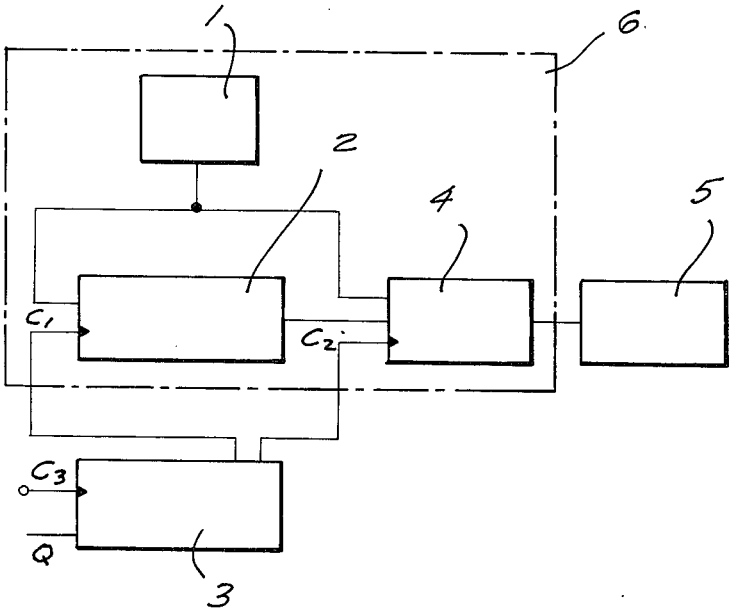
FIG. 1 is a schematic block diagram of a first embodiment of the inventive control system.

FIG. 1 depicts in schematic block-diagram form the design of the printing machine control system including a clocked control unit 3 and means for compensating for the dead times of positioning units. The control unit 3 is clocked by clock pulses $C_3$ received on its clock input; additionally, it registers a signal Q associated with the control system of the printing machine, for example a printing-roller throw-on signal.

Connected between the clocked control unit 3 and the positioning unit 5 which exhibits dead time in its response to an activating signal, is a unit 6 for compensating for the dead time. Unit 6 comprises a clocked calculating unit 2 clocked by clock pulses $C_1$ received at its clock input and furthermore comprises a unit 4, connected to the output of calculating unit 2, and operative for converting the result of the computation performed by calculating unit 2 into a valve corresponding to degrees of rotation of the rotary reference component of the printing machine. Converter unit 4 likewise is a clocked unit, clocked by clock pulses $C_2$ received at its clock input from unit 3.

A pulse generator 1 is operative for generating pulses synchronized with rotation of the rotary reference component (e.g., printing cylinder or main drive shaft) of the printing machine; pulse generator 1 generates one pulse per preselected unit of angular rotation of the rotary reference component. For example, pulse generator 1 could be essentially comprised of a perforated synchronizer disk rotating in synchronism with the rotary reference component, with a cooperating photodetector sensing the synchronizing peforations and generating one output pulse per synchronizing perforation. Pulse generator 1 forms part of the unit 6 which compensates for the dead time of positioning unit 5; additionally, pulse generator 1 furnishes pulses to calculating unit 2 and to converter unit 4. The clocked control unit 3 registers the command signal Q, which is transmitted upon the generation of the clock pulse $C_1$ for activating the positioning unit 5 (e.g., for throw-on or throw-off of a printing cylinder, or the like) without separately taking into account the prevailing instantaneous angular velocity of the rotary reference component of the printing machine.

The angular velocity of the reference component is taken into account by the unit 6 which effects the dead-time compensation.

When the clocked control unit 3 produces the clock pulse $C_1$, the calculating unit 2 is activated for calculation of the delay angle in accordance with the equation presented above. The required information concerning the angular velocity of the rotary reference component of the printing machine is supplied by the pulse generator 1.

Upon completion of the calculation, the calculated value is transmitted into the converter unit 4 as soon as the latter receives its clock pulse $C_2$ from control unit 3. Thereupon, converter unit 4, under the control of pulse generator 1, converts the calculated value into a form suitable for effecting the actual dead-time compensation, e.g. by establishing the actual compensatory time delay by the amount of which the application of an activating signal to the positioning unit 5 is to be delayed.

In the embodiment of FIG. 1, the compensating unit 6 which compensates for the dead time in the response of positioning unit 5 to the receipt of an activating signal, is connected to the output of the clocked control unit 3.

Figure 2:
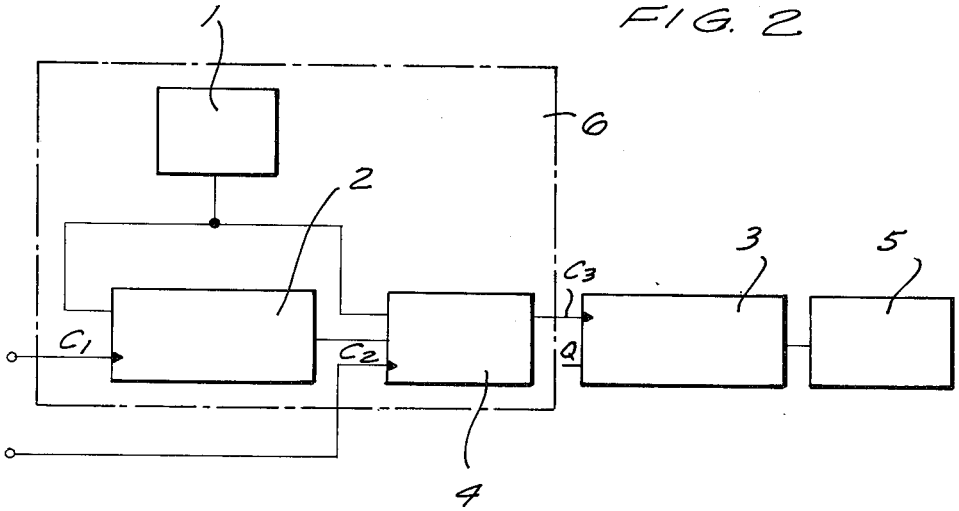
FIG. 2 is a schematic block diagram of a second embodiment.

In the embodiment of FIG. 2, the situation is reversed. The clocked control unit 3 is connected to the output of the compensating unit 6.

In FIG. 2, the control system includes again a clocked control unit 3, but here unit 3 receives its clock pulses $C_3$ from the dead-time compensation unit 6; additionally, clocked control unit 3 registers a signal Q associated with the control of printing-machine operation, for example a command signal commanding printing-cylinder throw-on. The dead-time compensation unit 6 comprises a clocked calculating unit 2 clocked by clock pulses $C_1$, and connected to the output of unit 2 a clocked converter unit 4 clocked by clock pulses $C_2$ and operative for implementing the actual time delay in the activation of positioning unit 5 in dependence upon the result of the calculation performed by unit 2. The clock pulses $C_1$ and $C_2$ are furnished by a per se conventional synchronizer rotating in synchronism with the rotary reference component of the printing machine. The pulse generator 1, which provides the requisite information concerning increments of angular position of the rotary reference component, forms part of the dead-time compensation unit 6; additionally, pulse generator 1 furnishes its pulses to both the calculating unit 2 and the converter unit 4.

When the calculating unit 2 receives a clock pulse $C_1$, the calculating unit 2 is activated for calculating the delay angle in accordance with the equation presented above. The pulse generator 1 supplies the requisite information concerning the angular velocity of the rotary reference component of the printing machine. Upon completion of the calculation, the calculated value, upon application of a clock pulse $C_2$ to the unit 4, is transmitted to unit 4 and converted into a form suitable for actual implementation of the compensatory time delay. The time-delayed output signal of unit 4 is applied to the clock input of control unit 3 and serves as the clock pulse $C_3$ therefor; the clock pulse $C_3$ causes the command signal Q to be applied as an activating signal to the positioning unit 5 exhibiting the dead time to be compensated.

Figure 3:
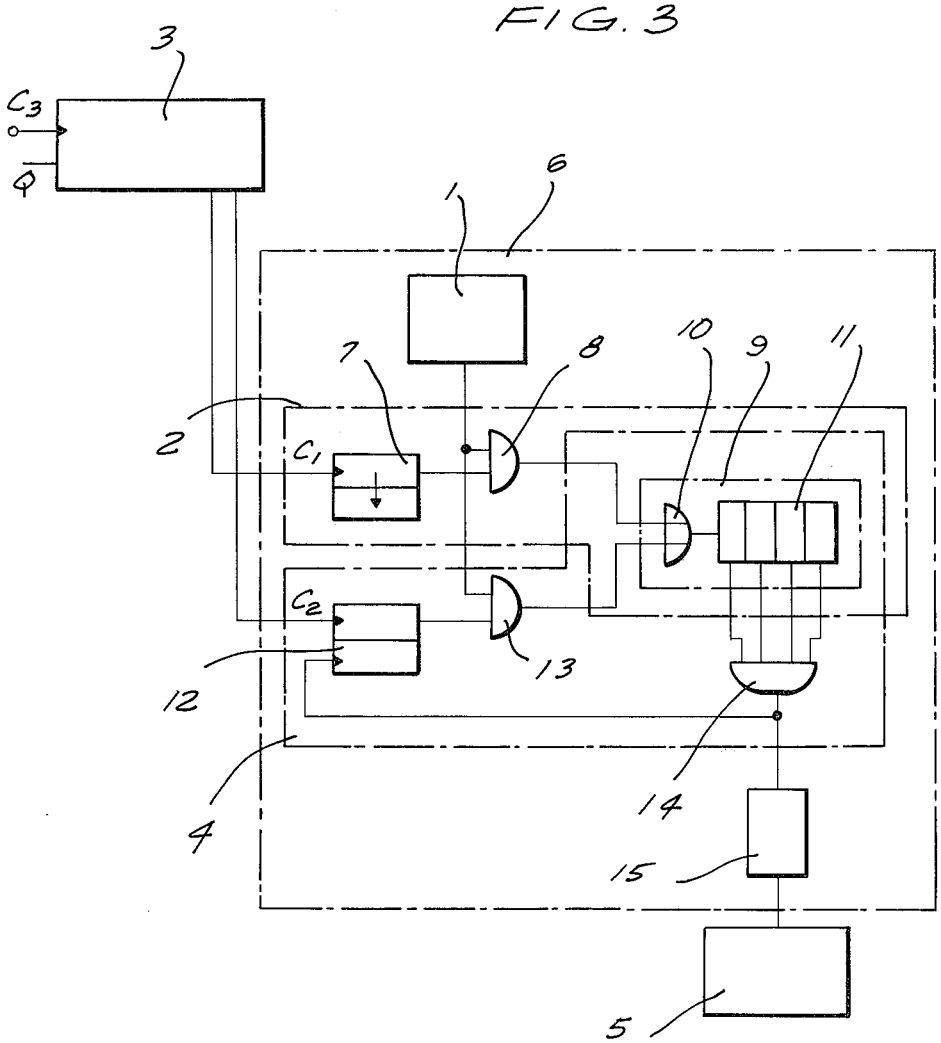
FIG. 3 depicts circuit details of the components of the control systems shown in FIGS. 1 and 2.

FIG. 3 depicts the embodiment of FIG. 1 in greater detail, i.e., the embodiment in which the compensating unit 6 is connected to the output of the clocked control unit 3, and not vice versa as in FIG. 2.

The dead-time compensating unit 6 includes the calculating unit 2, the converter unit 4, the pulse generator 1 and a signal matching unit 15 (which latter may be essentially comprised of, for example, an amplifier). The central processing unit 9 includes an OR-gate 10 and connected to the output of the latter a counter 11; depending upon which one of first and second AND-gates 8 and 13 is enabled, the central processing unit 9 becomes operatively associated with either the calculating unit 2 or else the converter unit 4.

The calculating unit 2 includes as its input stage a monostable multivibrator 7 which receives the clock pulses $C_1$ supplied by clocked control unit 3. The output of monostable multivibrator 7 controls the first AND-gate 8, the second input of which is connected to the output of pulse generator 1. The output of first AND-gate 8 is connected via the OR-gate 10 to the input of counter 11. The converter unit 4 includes as its input stage a bistable multivibrator 12 which receives the clock pulses $C_2$ from clocked control unit 3. The output of bistable multivibrator 12 controls the second AND-gate 13, the second input of which is connected to the output of pulse generator 1. The output of second AND-gate 13 is connected via OR-gate 10 to the input of counter 11.

The converter unit 4 additionally includes a third AND-gate 14 whose inputs are connected to the outputs of counter 11, for monitoring the count on the counter 11, as well as a signal matching stage 15 connected to the output of the third AND-gate 14.

It is the signal matching stage 15 which furnishes the activating signal per se to the positioning unit 5 possessed of the dead time to be compensated for.

The resetting of the bistable multivibrator 12 is performed by means of the third AND-gate 14.

The clocked control unit 3 registers a command signal Q associated with the control of the operation of the printing machine (e.g., a printing-cylinder throw-on command signal) and processes signal Q in dependence upon the receipt of a clock pulse $C_3$ furnished in synchronism with the rotation of the rotary reference component of the printing machine. To compensate for the dead time in the response of the positioning units to activating signals, the clocked control unit 3 has connected to its output a dead-time compensating unit 6.

The sequence of operations performed by the dead-time compensating unit 6 can be broken down into three successive phases:

calculation of the delay angle $\beta$
registration of the delay angle $\beta$
read-out of the delay angle and implementation of the actual delay.

The operations performed by compensating unit 6 will be explained with reference to these three phases of operation. The earlier-presented equation for the delay angle $\beta$ is implemented in digitally quantized form.

Calculation of the delay angle $\beta$

This phase is initiated upon generation of a clock pulse $C_1$ and is performed in the calculating unit 2. The clock pulse $C_1$ furnished by the clocked control unit 3 starts the monostable multivibrator 7, i.e. triggers the latter to its unstable state, whereupon multivibrator 7 enables AND-gate 8, the other input of which is connected to the output of pulse generator 1. During the unstable period of multivibrator 7, the pulses being generated by pulse generator 1 are transmitted to the central processing unit 9, through the OR-gate 10 and into the counter 11.

Registration of the delay angle $\beta$:

This phase is performed during the unstable period of the monostable multivibrator 7. As the pulses from pulse generator 1 are fed into counter 11, the count on counter 11 increases. The count accumulated on counter 11 during the calculation of the delay angle $\beta$ — i.e., during the unstable period of monostable multivibrator 7 — characterizes the term $(aw)$ in the earlier-presented equation for the delay angle $\beta$. If the maximum count which counter 11 is capable of assuming corresponds to $b$ bits, then the difference between the count on counter 11 and the maximum possible count represents the term $(b - aw)$ in the delay-angle equation.

Read-out of the delay angle $\beta$ and implementation of the compensatory time delay.

This phase is initiated upon generation of a clock pulse $C_2$ and is performed in the converter unit 4. The clock pulse $C_2$ furnished by clocked control unit 3 sets the bistable multivibrator 12. The set bistable multivibrator 12 enables the second AND-gate 13 for transmission of the angular-increment pulses from pulse generator 1 to the central processing unit 9.

The angular-increment pulses are transmitted from the output of second AND-gate 13 via the OR-gate 10 to the counter 11; it is to be recalled that during the first phase of operation (the calculation of the delay angle) the count accumulated on counter 11 will not in general have reached the maximum possible count.

Accordingly, the angular-increment pulses furnished by pulse generator 1 to counter 11 during this third phase of operation cause the counter 11 to count from the count achieved during the first phase of operation up to the maximum possible count. When counter 11 reaches its maximum possible count, this is detected by AND-gate 14, because all counter outputs carry "1" signals when the maximum count is reached.

It will be appreciated that the number of these additional angular-increment pulses required to bring the count up to the maximum count corresponds, in digitally quantized form, to the term $(b - aw)$ in the delay-angle equation. Moreover, since these additional angular-increment pulses are being furnished at a rate proportional to the angular velocity of the rotary reference component of the printing machine, the duration of the third phase (i.e., the time required for the count to be brought up to the maximum count) itself constitutes a time-delay interval directly utilizable as the compensatory time delay for compensating for the dead time in the response of positioning unit 5 to an applied activating signal. It is in this sense that converter unit 4 converts the value calculated by calculating unit 2 into a form suitable for implementation of the actual compensatory time delay.

In any event, when the maximum count is thusly reached, a "1" signal appears on the output of AND-gate 14. This signal resets the bistable multivibrator 12, thereby disabling AND-gate 13; additionally, the "1" signal at the output of AND-gate 14 is applied to the signal matching stage 15 which, in response, furnishes the activating signal, per se, for activating the positioning unit 5. The positioning unit 5 does not form part of the converter unit 4. The signal matching stage 15 serves to convert the logical "1" signal at the output of AND-gate 14 into a suitable activating signal for the positioning unit 5. For example, stage 15 may be essentially comprised of an amplifier, with the possible inclusion of a monostable or bistable multivibrator; a monostable multivibrator would be used, for example, if the activating signal is to be of limited duration, e.g. if a printing cylinder is to be thrown on and then after the elapse of the unstable period of the multivibrator thrown off; a bistable multivibrator would be used, for example, if the activating signal is to be of indefinite duration, e.g. if the printing cylinder is to be thrown on and remain thrown on until another positioning unit, like unit 5, is activated for effecting throw-off.

In the foregoing description, reference was made to the dead time in the response of the positioning unit 5 to receipt of an activating signal. However, dead time in the response to receipt of a deactivating signal presents the same problem, and can be compensated for in the same way. In general, reference to activation of the positioning unit refers both to units which effect, for example, engagement of a printing cylinder or another such component, and likewise units which effect disengagement; likewise the term activation is used to cover both the cases of deenergization and energization of a positioning or moving unit.

If the positioning units of the printing machine (of which only one is shown in each Figure) exhibit different dead times, this is taken into account by correspondingly selecting the unstable period of the monostable multivibrators 7 and the maximum possible count of the counters 11 of the compensating units 6 associated with the respective positioning units 5. The unstable period of the monostable multivibrator 7, the amount of the angular increment to which each pulse furnished by pulse generator 1 corresponds, and the maximum count of which counter 11 is capable, can all be interdependently selected to minimize circuitry expense, especially for the counters, limited, however, by the contemplated range of operating speeds of the printing machine, since greater precision results when the angular increments corresponding to each pulse are very small. It will be appreciated that the unstable period of the monostable multivibrator 7 is selected in correspondence to the dead time $t_T$ of the positioning unit 5 in question. The unstable period of multivibrator 7 determines the maximum delay angle $\beta$ which can be achieved, if the maximum count of counter 11 is given. Additionally, the angle $\gamma$ between the printing-machine-synchronized clock pulses $C_1$ and $C_2$ should be in accordance with the equation $$\gamma = T_T \cdot w_{max}$$

In the foregoing, the clocked control unit 3 and the positioning unit 5 exhibiting the dead time to be compensated for, have been described in general terms.

One contemplated context for the illustrated circuitry is of the type disclosed, for example, in U.S. Pat. No. 3,818,827, issued June 25, 1974, to Albrecht Johne et al.

In U.S. Pat. No. 3,818,827, the operation of functional units of a printing machine (e.g., electromagnetic or electrohydraulic positioning units which throw printing cylinders, or the like, on and off, i.e. into operative and inoperative positions) is controlled by a shift register. A sheet to be printed is transported through the printing machine along a predetermined path. As the sheet enters the path, it is sensed by a sensor which applies a sheet-representing signal to the information-signal input of the control shift register. The clock-signal input of the shift register receives clock pulses from a mechanical synchronizer synchronized with a rotary component of the printing machine. As the sensed sheet thereafter travels along the predetermined path through the printing machine, the corresponding sheet-representing signal (for example a logical "1" signal) advances through the successive stages of the control shift register, in simulation of the travel of the sheet through the printing machine, under the control of the synchronizing or clock pulses being applied to the shift register.

When the sheet-representing signal reaches a predetermined point along its path of travel, a functional unit is to be activated — e.g., a printing cylinder is to be thrown on. The reaching of this point by the sheet is simulated by the reaching of a corresponding shift-register stage by the sheet-representing signal. Accordingly, a sampling stage is connected to the shift-register stage in question, for detecting when the sheet-representing signal reaches the shift-register stage in question, and in response to such detection, applies an activating signal to a functional unit (for example, activating an electromagnetic or electrohydraulic positioning means which moves a printing cylinder from thrown-off to thrown-on position, to print upon the sheet).

In the embodiments of the present invention depicted in FIGS. 1 and 3, clocked control unit 3 can be a control shift register such as shown in U.S. Pat. No. 3,818,827. The Q signal would accordingly be a sheet-representing signal. The $C_1$ and $C_2$ outputs of clocked control unit 3 would be sampling lines connected to those shift-register stages corresponding to the moments in time at which the operations triggered by pulses $C_1$ and $C_2$ (described above) are to be initiated. In that event, the Q signal, referred to above as being for example a command signal for printing-cylinder trow-on, would constitute, more generally, the sheet-representing signal, and would constitute the throw-on command signal in particular only when it reached the shift-register stages to which the $C_1$ and $C_2$ sampling lines for the cylinder-throw-on positioning unit 5 are connected. If the positioning unit 5 exhibited no dead time in its response to an activating signal, and if furthermore the printing cylinder were to be thrown on (or another such functional unit activated) at exactly the moment at which the sheet-representing signal arrived at the corresponding shift-register stage, then the activating signal could be furnished to the positioning unit at the exact moment at which the sheet-representing signal reached such shift-register stage. However, with the inventive expedient, because of the dead-time compensation, the $C_1$ sampling line will be connected further upstream along the series of shift-register stages, so that the deliberate compensatory time delay in the generation of the activating signal per se will be taken into account and generation of the activation signal per se will occur at the proper moment.

In the embodiment of the present invention shown in FIG. 2, the dead-time compensating unit 6 is connected to the clock input $C_2$ of the clocked control unit 3. In this case, the control unit 3 could again be a control shift register such as described above, with Q again being the sheet-representing signal. The $C_1$ and $C_2$ clock inputs for the compensating unit 6 would, in that case, receive clock pulses directly from a mechanical synchronizer rotating in synchronism with the rotary reference component of the printing machine. The positioning unit 5 would then be activated in direct response to the arrival of the sheet-representing signal Q at a shift-register stage corresponding to the point along the travel path of the sheet through the machine at which the positioning unit 5 is to be activated. Here, the compensatory time delay would be introduced into the clocking of the shift register itself.

Alternatively, in FIG. 2, the clocked control unit 3 need not be an entire shift register, but instead an AND-gate having one input (the Q input) connected to a preselected one of the stages of the control shift register proper, with its other input accordingly constituting the $C_3$ clock input. Here again, the $C_1$ and $C_2$ clock pulses could be supplied directly by a mechanical or electromechanical synchronizer. However, the $C_3$ clock pulse would not result in activation of positioning unit 5, until such time as the Q signal reached the shift-register stage to which the Q input of control unit 3 is connected.

In FIGS. 1 and 3, with clocked control unit 3 being the main (sheet-travel-simulation) shift register, other (non-illustrated) positioning units 5 and associated compensating means 6 will be provided,. These other units 5, 6 will have respective $C_1$, $C_2$ clock pulse inputs connected to the outputs of other preselected shift-register stages of the shift register 3.

Likewise, in FIG. 2, if clocked control unit 3 is the main (sheet-travel-simulation) shift register, it is to be understood that positioning unit 5 is connected to the output of a preselected one of the shift-register stages, and that other (non-illustrated) positioning units 5 are connected to the outputs of other preselected shift-register stages.

It will be understood that each of the elements described above, or two or more together, may also find a useful application in other types of circuits and constructions, differing from the types described above.

While the invention has been illustrated and described as embodied in a shift-register control system, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An improved control system for a variable-speed cyclically operating printing machine, the control system being of the type including a clocked control unit receiving printing-machine-synchronized clock signals and being operative in dependence thereon for generating activating signals, the control system furthermore including at least one positioning unit connected to receive activating signals from the clocked control unit but exhibiting a dead time in its response to activating signals, the duration of the dead time not varying linearly with the speed of operation of the printing machine, whereby the fraction of a printing-machine operating cycle constituted by the duration of the dead time varies as the speed of operation of the printing machine varies, the improvement comprising the provision of pulse-generating means operative for generating pulses corresponding to angular increments in the angular position of a rotary reference component of the printing machine; and time-delay means connected to the pulse-generating means and to the clocked control unit and operative for automatically compensating for variations in the fractional relationship between the printing-machine operating-cycle duration and the dead-time duration by introducing, into the transmission of an activating signal from the clocked control unit to the positioning unit, a compensatory time delay whose duration offsets variations in the fractional relationship, the time-delay means comprising calculating and converting means operative for calculating from the pulses a digital value indicative of the compensatory time delay needed to offset variations in the fractional relationship and operative for converting the calculated value into said compensatory time delay.

2. In a printing machine as defined in claim 1, the clocked control unit being connected at its input to the outputs of the pulse-generating means and of the calculating and converting means and being controlled by the latter and being connected at its output to the positioning unit and controlling the latter.

3. In a printing machine as defined in claim 1, the calculating and converting means being connected at its output to the input of the clocked control unit.

4. In a printing machine as defined in claim 1, the clocked control unit comprising a sheet travel simulation control circuit.

5. In a printing machine as defined in claim 1, the calculating and converting means comprising calculating means operative for calculating from the pulses the digital value indicative of the compensatory time delay needed and converting means operative for converting the calculated value into said compensatory time delay, the calculating means comprising a monostable multivibrator, a first AND-gate having one input connected to the output of the multivibrator and another input connected to the output of the pulse-generating means, and a central processing unit including an OR-gate having an input connected to the output of the AND-gate and a counter having an input connected to the output of the OR-gate.

6. In a printing machine as defined in claim 5, the converting means also including said central processing unit and thereby sharing said central processing unit with said calculating means, the converting means furthermore including a second AND-gate having an output connected to another input of the OR-gate, the second AND-gate having one input connected to the output of the pulse-generating means, a bistable multivibrator having an output connected to another input of the second AND-gate, and a third-AND-gate having inputs connected to all the outputs of the counter.

7. In a printing machine as defined in claim 6, the bistable multivibrator having a reset input connected to the output of the third AND-gate.

8. In a printing machine as defined in claim 5, the unstable period of the monostable multivibrator being equal to the dead time of the positioning unit.

9. In a printing machine as defined in claim 1, the calculating and converting means comprising clocked calculating means operative in response to a clock pulse for calculating the digital value indicative of the needed compensatory time delay, clocked converting means operative in response to a clock pulse for converting the calculated value into said compensatory time delay, and means furnishing clock pulses to the clocked calculating means and the clocked converting means, the phase angle difference between the clock pulses furnished to the calculating means and those furnished to the converting means being equal to the product of the dead time duration of the positioning unit and the maximum angular velocity of the rotary reference component of the printing machine.

* * * * *